US006858572B1

(12) United States Patent
Mort, III

(10) Patent No.: US 6,858,572 B1
(45) Date of Patent: Feb. 22, 2005

(54) PROCESS FOR PRODUCING COATED DETERGENT PARTICLES

(75) Inventor: Paul R Mort, III, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/914,527

(22) PCT Filed: Mar. 8, 2000

(86) PCT No.: PCT/US00/05983

§ 371 (c)(1),
(2), (4) Date: Aug. 29, 2001

(87) PCT Pub. No.: WO00/53714

PCT Pub. Date: Sep. 14, 2000

Related U.S. Application Data

(60) Provisional application No. 60/127,772, filed on Apr. 5, 1999, and provisional application No. 60/123,443, filed on Mar. 9, 1999.

(51) Int. Cl.[7] ..... C11D 17/06
(52) U.S. Cl. ..... 510/442; 510/444
(58) Field of Search ..... 510/441, 442, 510/443, 444

(56) References Cited

U.S. PATENT DOCUMENTS

| | | | |
|---|---|---|---|
| 3,816,319 | A | 6/1974 | Sarot et al. |
| 4,105,827 | A | 8/1978 | Brichard et al. |
| 4,846,409 | A | 7/1989 | Kaspar et al. |
| 4,919,847 | A | 4/1990 | Barletta et al. |
| 5,108,646 | A | 4/1992 | Beerse et al. |
| 5,478,488 | A | 12/1995 | Doetsch et al. |
| 5,576,285 | A | 11/1996 | France et al. |
| 5,707,953 | A | 1/1998 | Land et al. |
| 5,916,868 | A | 6/1999 | Mazzola et al. |

FOREIGN PATENT DOCUMENTS

| | | |
|---|---|---|
| DE | 44 35 743 A1 | 8/1995 |
| DE | 196 51 446 | 6/1998 |
| DE | 197 13 328 A1 | 10/1998 |
| EP | 0 057 611 A2 | 8/1982 |
| EP | 0 353 976 A1 | 2/1990 |
| EP | 0 651 053 A1 | 5/1995 |
| WO | WO 94/24260 | 10/1994 |
| WO | WO 97/12955 | 4/1997 |
| WO | WO 97/22685 | 6/1997 |
| WO | WO 97/28246 | 8/1997 |
| WO | WO 99/00475 | 1/1999 |

*Primary Examiner*—John Hardee
(74) *Attorney, Agent, or Firm*—Brian M. Bolam; Brahm J. Corstanje; Kim William Zerby

(57) ABSTRACT

A process for preparing detergent particles having a coating layer of a water-soluble inorganic material is provided. The detergent particle comprises a particle core of a detergent active material. This particle core is then at least partially covered by a particle coating layer of a water soluble inorganic material. Particularly preferred are non-hydratable inorganic coating materials including double salt combinations of alkali metal carbonates and sulfates. The particle coating layer may also include detergent adjunct ingredients such as brighteners, chelants, nonionic surfactants, co-builders, etc. The process includes the steps of passing the particle core through a coating mixer such as a low speed mixer or fluid bed mixer and coating the particle core with a coating solution or slurry of the water soluble inorganic material. Upon drying, the resultant detergent particles have improved appearance and flow properties and may be packaged and sold as a detergent material or mixed with various other detergent ingredients to provide a fully formulated detergent composition.

5 Claims, No Drawings

PROCESS FOR PRODUCING COATED DETERGENT PARTICLES

This application is a 371 of PCT/US00/05983 filed Mar. 8, 2000, which claims benefit of Provisional Application 60/123,443 filed Mar. 9, 1999, and claims benefit of Provisional Application 60/127,772 filed Apr. 5, 1999.

FIELD OF THE INVENTION

The present invention relates to detergent particles and a process for producing the particles. More particularly, the present invention relates detergent particles having a non-hydrating coating layer and a process for producing these particles from solutions of the inorganic material.

BACKGROUND OF THE INVENTION

Recently, there has been considerable interest within the detergent industry for laundry detergents which have the convenience, aesthetics and solubility of liquid laundry detergent products, but retain the cleaning performance and cost of granular detergent products. The problems, however, associated with past granular detergent compositions with regard to aesthetics, solubility and user convenience are formidable. Such problems have been exacerbated by the advent of "compact" or low dosage granular detergent products which typically do not dissolve in washing solutions as well as their liquid laundry detergent counterparts. These low dosage detergents are currently in high demand as they conserve resources and can be sold in small packages which are more convenient for consumers prior to use, but less convenient upon dispensing into the washing machine as compared to liquid laundry detergent which can be simply poured directly from the bottle as opposed to "scooped" from the box and then dispensed into the washing solution.

Granular detergent products are typically produced from one of two manufacturing methods. The first involves the spray-drying of a aqueous detergent slurry in a spray drying tower to produce detergent granules while the second involves dry mixing various components after which they are agglomerated with a binder such as surfactant. The resultant detergent particles are then dried to achieve an acceptable moisture content such that the finished product is flowable and non-caking in the package once delivered to the consumer. In both processes, the factors which impact these flow characteristics include chemical composition and type and length in the drying process.

Many surfactant materials included in granular detergents, including linear alkyl benzene sulfonates ("LAS"), ethoxylated alkyl sulfates and nonionic surfactants, tend to be relatively "sticky" in nature, difficult to fully dry and lead to lumping, caking and flowability problems in the finished product. Accordingly, there exists a need to reduce the flowability problems associated with these "sticky" surfactants in finished detergent products.

In addition, detergent processes in which inorganic materials are incorporated into the process are well known. For example, U.S. Pat. No. 5,576,285 discloses the use of inorganic double salts as dry mix ingredients in an agglomeration process as well as the dry coating of aluminosilicates, carbonates and silicates as flow control agents. In these processes, the coating material is applied as a dry ingredient and merely dusts or sticks to the outside of the particles rather than as a true coating adhering to the particle itself. This patent also discloses the spraying of liquid binder materials such as water, surfactants, polymers, etc. into the mixers or fluid bed of a detergent process. Additional patents teach spraying various materials including alkali metal silicates and surfactants into a detergent making process including PCT applications WO97/22685 and WO99/00475 and German patent application DE 4435743. However, in the case of silicate coatings, the hygroscopic nature of the silicate can lead to moisture uptake during storage of the detergent, especially in humid conditions; moisture adsorption results in caking and lumping of the detergent powder, causing poor scoop and flow properties and degraded aesthetics of the product.

Accordingly, the need remains for a process which can produce a detergent granule having improved flow properties and aesthetics and which may be included in detergent compositions.

SUMMARY OF THE INVENTION

This need is met by the present invention wherein a process for producing a detergent particle that has improved surface, appearance and flow properties is provided. The particles of the present invention have improved surface properties in that they are smoother and have a generally more uniform surface and appearance than prior art detergent particles. Further, the appearance of the particles have been improved in that they appear brighter and whiter than currently available detergent particles and have improved flow properties where the particles have reduced lumping and caking profiles.

In accordance with the present invention, a process for preparing detergent particles having a coating layer of a water-soluble material is provided. The detergent particle comprises a particle core of a detergent active material such as conventional detergent particles of surfactant and carbonate blends or individual detergent ingredients such as enzymes, bleaching agents, etc. This particle core is then at least partially covered by a particle coating layer of a water soluble material which imparts the aforementioned improved properties. Particularly preferred are non-hydratable inorganic coating materials including double salt combinations of alkali metal carbonates and sulfates. The particle coating layer may also include detergent adjunct ingredients such as brighteners, chelants, nonionic surfactants, co-builders, etc.

The process includes the steps of passing the particle core as defined above through a coating mixer such as a low speed mixer or fluid bed mixer and coating the particle core with a coating solution or slurry of the water soluble, non-hydrating inorganic material. Upon drying, the resultant detergent particles have improved appearance and flow properties and may be packaged and sold as a detergent material or mixed with various other detergent ingredients to provide a fully formulated detergent composition.

Accordingly, it is an object of the present invention to provide a process for producing a detergent particle having improved appearance and flow characteristics by coating a detergent core material with a layer of water soluble non-hydrating inorganic materials. It is a further object of the present invention to provide a process for preparing the detergent particle via coating in a mixer with solutions or slurries of the inorganic materials. These and other objects features and advantages of the present invention will become apparent to those skilled in the art from a reading of the following detailed description and the appended claims.

DETAILED DESCRIPTION OF THE PREFERRED EMBODIMENTS

Definitions

As used herein, the word "particles" means the entire size range of a detergent final product or component or the entire size range of discrete particles, agglomerates, or granules in a final detergent product or component admixture. It specifically does not refer to a size fraction (i.e., representing less than 100% of the entire size range) of any of these types of particles unless the size fraction represents 100% of a discrete particle in an admixture of particles. For each type of particle component in an admixture, the entire size range of discrete particles of that type have the same or substantially similar composition regardless of whether the particles are in contact with other particles. For agglomerated components, the agglomerates themselves are considered as discrete particles and each discrete particle may be comprised of a composite of smaller primary particles and binder compositions.

As used herein, the phrase "geometric mean particle diameter" means the geometric mass median diameter of a set of discrete particles as measured by any standard mass-based particle size measurement technique, preferably by dry sieving. As used herein, the phrase "geometric standard deviation" or "span" of a particle size distribution means the geometric breadth of the best-fitted log-normal function to the above-mentioned particle size data which can be accomplished by the ratio of the diameter of the 84.13 percentile divided by the diameter of the $50^{th}$ percentile of the cumulative distribution ($D_{84.13}/D_{50}$): See Gotoh et al, *Powder Technology Handbook*, pp. 6–11, Marcel Dekker 1997.

As used herein, the phrase "builder" means any inorganic material having "builder" performance in the detergency context, and specifically, organic or inorganic material capable of removing water hardness from washing solutions. As used herein, the term "bulk density" refers to the uncompressed, untapped powder bulk density, as measured by pouring an excess of powder sample through a funnel into a smooth metal vessel (e.g., a 500 ml volume cylinder), scraping off the excess from the heap above the rim of the vessel, measuring the remaining mass of powder and dividing the mass by the volume of the vessel.

As used herein, "composition" and "granular detergent composition" are intended to include both final products and additives/components of a detergent composition. That is, the compositions produced by the processes claimed herein may be complete laundry detergent compositions or they may be additives that are used along with other detergent ingredients for laundering fabrics and the like.

As used herein, "surface area" mean the total amount of surface of a powder available for gas adsorption and thus includes both internal (i.e. that within cracks and crevices) and external surface area. Surface area is measured using BET multi point surface area analysis.

Particle Core

The novel detergent particles of the present invention comprise a particle core which is at least partially coated with a water soluble coating material. In preferred embodiments, the particle core may comprise a detergent particle, agglomerate, flake, etc. Thus, the particle core will preferably comprise a blend of surfactant ingredients, particularly anionic surfactants with dry detergent ingredients such as carbonates, aluminosilicate builders, silicate builder materials, alkali metal sulfates, chelants and various other dry detergent ingredients in minor amounts. Alternatively, the particle core may comprise an individual detergent ingredient such as an enzyme, bleaching agent, perfume or mixtures thereof.

Particularly preferred particle cores include detergent agglomerates formed by an agglomeration of a highly viscous surfactant paste or a liquid acid precursor of a surfactant and the aforementioned dry detergent ingredients. The agglomeration of the surfactant material and dry detergent material may be carried out in a high or moderate speed mixer after which an optional low or moderate speed mixer may be employed for further agglomeration, if necessary.

Alternatively, the agglomeration may be carried out in a single mixer that can be low, moderate or high speed. The particular mixer used in the present process should include pulverizing or grinding and agglomeration tools so that both techniques can be carried forth simultaneously in a single mixer. To that end, it has been found that the first processing step can be successfully completed, under the process parameters described herein, in a Lodige KM™ (Ploughshare) 600 moderate speed mixer, Lodige CB™ high speed mixer, or mixers made by Fukae, Drais, Schugi or similar brand mixer. The Lodige KM™ (Ploughshare) 600 moderate speed mixer, which is a preferred mixer for use in the present invention, comprises a horizontal, hollow static cylinder having a centrally mounted rotating shaft around which several plough-shaped blades are attached. Preferably, the shaft rotates at a speed of from about 15 rpm to about 140 rpm, more preferably from about 80 rpm to about 120 rpm. The grinding or pulverizing is accomplished by cutters, generally smaller in size than the rotating shaft, which preferably operate at about 3600 rpm. Other mixers similar in nature which are suitable for use in the process include the Lodige Ploughshare™ mixer and the Drais® K-T 160 mixer.

Preferably, the mean residence time of the various starting detergent ingredients in the low, moderate or high speed mixer is preferably in range from about 0.05 minutes to about 15 minutes, most preferably the residence time is about 0.5 to about 5 minutes. In this way, the density of the resulting detergent agglomerates is at the desired level.

This agglomeration is typically followed by a drying step. This drying step may be carried out in a wide variety of equipment including, but not limited to a fluid bed drying apparatus. Examples of dryer characteristics include fixed or vibrating; rectangular bed or round bed; and straight or serpentine dryers. Manufacturers of such dryers include Niro, Bepex, Spray Systems and Glatt. By way of example, apparatus such as a fluidized bed can be used for drying while an airlift can be used for cooling should it be necessary. The air lift can also be used to force out the "fine" particles so that they can be recycled to the particle agglomeration process.

The particles of the present invention comprise at least about 50% by weight of particles having a geometric mean particle diameter of from about 500 microns to about 1500 microns and preferably have a geometric standard deviation of from about 1 to about 2. Preferably the geometric standard deviation is from about 1.0 to about 1.7, preferably from about 1.0 to about 1.4. The granular detergent composition resulting from the processes may comprise fine particles, wherein "fine particles" are defined as particles that have a geometric mean particle diameter that is less than about 1.65 standard deviations below the chosen geometric mean particle diameter of the granular detergent composition. Large particles may also exist wherein "large particles" are defined as particles that have a geometric mean particle diameter that is greater than about 1.65 standard deviations above the chosen geometric mean particle diameter of the granular detergent composition. The fine particles are preferably separated from the granular detergent composition and returned to the process by adding them to at least one of the mixers and/or the fluid bed dryer as described in detail below. Likewise, the large particles are preferably separated from the granular detergent composition and then fed to a grinder where their geometric mean particle diameter is reduced. After the geometric mean particle diameter of the large particles is reduced, the large particles are returned to the process by adding them to at least one of the mixers and/or the fluid bed dryer.

The agglomeration may comprise the step of spraying an additional binder in the mixers to facilitate production of the desired detergent particles. A binder is added for purposes of enhancing agglomeration by providing a "binding" or "sticking" agent for the detergent components. The binder is preferably selected from the group consisting of water, anionic surfactants, nonionic surfactants, polyethylene glycol, polyvinyl pyrrolidone polyacrylates, citric acid and mixtures thereof. Other suitable binder materials including those listed herein are described in Beerse et al, U.S. Pat. No. 5,108,646 (Procter & Gamble Co.), the disclosure of which is incorporated herein by reference.

Another optional processing step to form the particle core of the present invention includes continuously adding a coating agent such as zeolites, recycled "fines" as described above and fumed silica to the mixer to improve the particle color, increase the particle "whiteness or facilitate free flowability of the resulting detergent particles and to prevent over agglomeration. When employing recycled fines as the coating agent, the fines are preferably in the approximate size range of 0.1 to 0.5 times the mean particle size of the larger particles. The particle coating layer will also improve the integrity of the fines layering and provide abrasion and attrition resistance during handling. In addition, the detergent starting materials can be fed into a pre-mixer, such as a Lodige CB mixer or a twin-screw extruder, prior to entering in the mixer. This step, although optional, does indeed facilitate agglomeration.

Also particularly preferred in the present invention are particle cores which comprise tower blown particles. In this process, the core particle is formed by the preparation of a slurry of surfactant materials, water and dry starting detergent materials. The resultant slurry is then passed to a tower where the slurry is sprayed into a stream of air at temperatures typically ranging from about 175° C. to about 225° C. to dry the detergent slurry and formed detergent particles. Typically, resultant densities of these particles range from about 200 to about 500 g/l.

Particle Coating Layer

As described hereinbefore, the particle coating layer of the present invention is a water soluble coating material. The particle coating layer imparts dramatically new surface and appearance properties on the detergent particles of the present invention. The coated particles of the present invention have an appearance which is brighter and/or whiter than current detergent particles. This provides a more favorable response from consumers who prefer white detergent products. In addition, the particle coating layer of the present invention imparts a dramatically improved feel to the particles of the present invention. The coated particles of the present invention have a glassy, smoother feel than prior art detergent products. This again provides a more favorable response from consumers who prefer a rounded, uniform product. Additionally, the coated particles of the present invention provide improved sound to a detergent product containing the particles of the present invention. The coated particles have a crisper sound than current detergent products, thereby leaving the consumer with a more favorable overall impression of the product.

Most importantly, the coated particles of the present invention provide improved clumping and flowability profiles to detergent products containing the particles of the present invention. The particle coating layer provides a coating which is crisper and non-tacky. While effective at improving flowability in all detergent products, it is particularly effective at preventing clumping in products containing surfactants which are more difficult to dry to a non-tacky state including nonionic surfactants, linear alkyl benzene sulfonates ("LAS"), and ethoxylated alkyl sulfates or in detergent products containing high amounts of surfactant actives (i.e. greater than about 25 wt % surfactant active).

The particle coating layer of the present invention at least partially coats the particle core. While the desired state is for particles which are completely coated by the particle coating, it is, of course, anticipated that complete coverage will not be possible in all cases in a continuous, high speed manufacturing process. While it is rather difficult to quantify the extent of the coating layer coverage, it is observed that increasing the amount of coating solids, either by increasing the solids concentration in the solution or by spraying on more of the solution, results in improved benefits and the appearance of a more uniform coverage. The benefits of increased coverage is balanced with the cost of drying excess water in the process. Accordingly, in preferred embodiments of the present invention, adequate coverage is achieved by applying coating solids at more than about 3 wt. % and most preferably more than about 5 wt. % of the particle core mass.

The particle coating layer of the present invention comprises a water soluble coating material. In preferred embodiments the coating material is not an alkali metal silicate as presents stability problems in the detergent composition and has a tendency to form insoluble residues in the processing of the detergent. The water soluble coating material is applied to provide a smoother more uniform appearance to the resultant detergent particles. The coating material may be selected from a wide variety of materials provided the coating imparts the appearance, flowability and surface properties described herein. Preferred materials include inorganic salts and organic salts, polymers and combinations thereof. Suitable organic salts include alkali metal carboxylates such as citrates and acetates. Inorganic salts may include silicates, boron salts, phosphate salts, magnesium salts and various other glass forming or crystalline inorganic salts. Most preferred are non-hydrating materials. By non-hydrating it is intended that the material does not have a strong tendency to react with environmental water such as moisture present in Hi composition or humidity in the air to form higher hydrate phases. For the purposes of the present invention, a non-hydrating coating means a coating layer in which at least 40 wt. % of the coating consists of a non-hydrating inorganic material, preferably more than about 60 wt. % and most preferably more than about 80 wt. % non-hydrating.

The non-hydrating material is preferably selected from alkali and/or alkaline earth metal sulfate and carbonate salts or mixtures of the two. A highly preferred materials are double salts of sulfate and carbonate having the formula $M_nX_n$:$MSO_4$:$MCO_3$, where MX can a salt compound such as a metal halide, and the molar fractions of $MSO_4$ and $MCO_3$ are both at least 10 mol % of the formula. More preferred, the molar ratio of $MSO_4$:$MCO_3$ is from about 90:10 to about 10:90 and more preferably from about 75:25 to about 60:40 where M independently represents an alkali or alkaline earth metal and n is an integer or fraction thereof from 0 to 5. Examples of these highly preferred materials are the water-free sulfates and water-free carbonate minerals that are formed naturally by evaporative deposition, such as Hanksite, KNa22(SO4)9(CO3)2Cl, and Tychite, Na6Mg2(CO3)4(SO4). An especially preferred material is a 2:1 molar ratio of the double salt $Na_2SO_4$:$Na_2CO_3$ otherwise known as "Burkeite", Na6(CO3)(SO4)2.

The particle coating layer may also include an detergent adjunct ingredient in addition to the particle coating material. These detergent adjunct ingredients may include a wide variety of ingredients, including but not limited to optical brighteners, pigments or dyes, chelants, nonionic surfactants, pH control agents, detergency co-builders and mixtures of these materials. Particularly preferred are pigments or dyes such as titanium dioxide, bluing agents such as copper sulfate, zinc thiosulfate and Ultramarine blue, Sparkle enhancers such as mica flake, and co-builders such as citrates and nonionic surfactants.

Coated Particles

The particles of the present invention are produced by coating the particle core as described hereinbefore with the particle coating material in a coating mixer. The coating mixer may be any of a number of mixers including high, moderate, and low speed mixers such as a Lodige KM™

(Ploughshare) 600 moderate speed mixer, Lodige CB™ high speed mixer, or mixers made by Fukae, Drais, Schugi or similar brand mixer. Particularly preferred for use in the present invention are low speed drum mixers and low shear fluidized bed mixers. When employing a low speed drum mixer in the present invention, the mixer is preferably followed in sequence by a drying apparatus, for example a fluid bed, wherein the coated particles are then dried to achieve the coated particles of the present invention.

In a preferred embodiment of the present invention, the coating mixer is a fluidized bed. The preferred particle core of detergent agglomerates, spray-dried particles or most preferably mixtures thereof is passed into a fluid bed dryer having multiple internal "stages" or "zones". A stage or zone is any discrete area within the dryer, and these terms are used interchangeably herein. The process conditions within a stage may be different or similar to the other stages in the dryer. It is understood that two adjacent dryers are equivalent to a single dryer having multiple stages. The various feed streams of particle core and coating material can be added at the different stages, depending on, for example, the particle size and moisture level of the feed stream. Feeding different streams to different stages can minimize the heat load on the dryer, and optimize the particle size and shape as defined herein.

Typically, the fluid bed mixer of the present invention comprises a first coating zone where the particle coating material of the present invention is applied. The coating zone involves the spraying of the coating material in aqueous or slurry form onto the fluidized particles. The bed is typically fluidized with heated air in order to dry or partially dry moisture from the spray coating as it is applied. The spraying is achieved via nozzles capable of delivering a fine or atomized spray of the coating mixture to achieve complete coverage of the particles. Typically, the droplet size from the atomizer is less than about 100 um. This atomization can be achieved either through a conventional two-fluid nozzle with atomizing air, or alternatively by means of a conventional pressure nozzle. To achieve this type of atomization, the solution or slurry rheology is typically characterized by a viscosity of less than about 500 centipoise, preferably less than about 200 centipoise. While the nozzle location in the fluid bed may be in most any location, the preferred location is a positioning that allows a vertical down spray of the coating mixture such as a top spray configuration. To achieve best results, the nozzle location is placed at or above the fluidized height of the particles in the fluid bed. The fluidized height is typically determined by a weir or overflow gate height. The coating zone of the fluid bed is then typically followed by a drying zone and a cooling zone. Of course, one of ordinary skill in the art will recognize that alternative arrangements are also possible to achieve the resultant coated particles of the present invention.

An alternative embodiment uses an agitated fluid bed, which includes mechanical and/or pneumatic mixing elements in addition to the conventional bed that is fluidized air passing through holes in a distributor plate. The advantage of the agitated bed is that it can be used to apply additional shear as a means to control granular shape and smoothness while performing the coating operation.

Typical conditions within a fluid bed or agitated fluid bed apparatus of the present invention include (i) from about 1 to about 20 minutes of mean residence time, (ii) from about 100 to about 600 mm of depth of unfluidized bed, (iii) preferably not more than about 50 micron of droplet spray size, (iv) from about 175 to about 250 mm of spray height, (v) from about 0.4 to about 2.0 m/s of fluidizing velocity and (vi) from about 12 to about 100° C. of bed temperature. Once again, one of ordinary skill in the art will recognize that the conditions in the fluid bed may vary depending on a number of factors.

The coated particles exiting the coating mixer may comprise in and of themselves a fully formulated detergent composition or in preferred embodiments may be admixed with additional ingredients, such as bleaching agents, enzymes, perfumes, non-coated detergent particles, and various other ingredients to produce a fully formulated detergent composition.

As previously stated, the coated particles of the present invention have improved surface properties in that the particles are more uniform in shape and smoother on the surface than the uncoated spray-dried or agglomerated detergent particles. These features are reflected in a reduction of the overall surface area of particles having the coating of the present invention as opposed to particles not having the coatings of the present invention. The coatings of the present invention reduce total surface area by smoothing irregularities and filling crevices on the surface of the particles. The coatings of the present invention provide a reduction in overall surface area as measured by she formula:

(Surface Area of Non-Coated Particles)−(Surface Area of Coated Particles)/(Surface Area of Non-Coated Particles)*100=Percent of Surface Area Reduction of at least about 10%, more preferably at least about 20% and most preferably at least about 30%. A reduction in surface area as provided by the present invention leads to improved flow properties and to improved overall aesthetics by providing a more reflective surface.

Surface Area Test Method

The surface area of the particles of the present invention are measured according to the following procedure. Detergent Particles are placed into a Micromeritics VacPrep 061, available from Micromeritics of Norcross, Ga., for pre-test preparation. The particles are placed under a vacuum of approximately 500 millitorr and heated to a temperature of between 80 and 100° C. for approximately 16 hours. The BET multi-point surface area is then measured in a Micromeritics Gemini 2375 surface area analyzer using a mixture of helium and nitrogen gases and the following general conditions: Evacuation rate—500.0 mmHg/min; Analysis Mode—Equilibration; Evacuation Time—1.0 min.; Saturation Pressure—771.77 mmHg: Equilibration Time—5 sec. Helium/Nitrogen Pressure—15 psig; Helium and Nitrogen purity 99.9%, free space is measured and P/Po points cover 0.05 to 0.3 with 5 data points taken.

Additionally, it is preferred to have a uniform distribution of shapes among the particles in the composition. Specifically, the granular detergent compositions of this invention have a standard deviation of the number distribution of circularity less than about 20, that is preferably less than about 10, more preferably less than about 7 most preferably less than about 4. And the standard deviation of the number distribution of aspect ratios is preferably less than about 1, more preferably less than about 0.5, even more preferably less than about 0.3, most preferably less than about 0.2.

In an especially preferred process of the present invention, granular detergent compositions are produced wherein the product of circularity and aspect ratio is less than about 100, preferably less than about 50, more preferably less than about 30, and most preferably less than about 20. Also preferred are granular detergent compositions with the standard deviation of the number distribution of the product of circularity and aspect ratio of less than about 45, preferably less than about 20, more preferably less than about 7 most preferably less than about 2.

In an optional embodiment of the present invention, the coated particles of the present invention may be treated with a post coating gloss treatment to provide a gloss layer on the coated detergent particle. The gloss layer may comprise inorganic salt materials, chelating materials, polymeric materials and mixtures thereof. Preferred inorganic materials are sulfate salts such as magnesium sulfate, preferred chelants are diamines such as ethylene diamine disuccinic acids (EDDS), while preferred polymers include acrylic polymers and copolymers such as acrylic/maleic copolymers.

Detergent Components

The surfactant system of the detergent composition may include anionic, nonionic, zwitterionic, ampholytic and cationic classes and compatible mixtures thereof. Detergent surfactants are described in U.S. Pat. No. 3,664,961, Norris, issued May 23, 1972, and in U.S. Pat. No. 3,919,678, Laughlin et al., issued Dec. 30, 1975, both of which are incorporated herein by reference. Cationic surfactants include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference.

Nonlimiting examples of surfactant systems include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3)alkyl sulfates of the formula $CH_3(CH_2)_x(CHOSO_3^-M^+)$ $CH_3$ and $CH_3$ $(CH_2)_y$ $(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10}$–$C_{18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the surfactant system. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

The detergent composition can, and preferably does, include a detergent builder. Builders are generally selected from the various water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates. Preferred are the alkali metal, especially sodium, salts of the above. Preferred for use herein are the phosphates, carbonates, silicates, $C_{10-18}$ fatty acids, polycarboxylates, and mixtures thereof. More preferred are sodium tripolyphosphate, tetrasodium pyrophosphate, citrate, tartrate mono- and di-succinates, sodium silicate, and mixtures thereof (see below).

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021: 3,422,137; 3,400,176 and 3,400,148, all of which are incorporated herein by reference.

Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include tie water-soluble salts of homo- and copolymers of aliphatic carboxylic acids such as maleic acid, itaconic acid, mesaconic acid, fumaric acid, aconitic acid, citraconic acid and methylenemalonic acid. Some of these materials are useful as the water-soluble anionic polymer as hereinafter described, but only if in intimate admixture with the nonsoap anionic surfactant.

Other suitable polycarboxylates for use herein are the polyacetal carboxylates described in U.S. Pat. No. 4,144,226, issued Mar. 13, 1979 to Crutchfield et al., and U.S. Pat. No. 4,246,495, issued Mar. 27, 1979 to Crutchfield et al., both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071. Bush et al., issued May 5, 1987, the disclosure of which is incorporated herein by reference.

Water-soluble silicate solids represented by the formula $SiO_2.M_2O$, M being an alkali metal, and having a $SiO_2$:$M_2O$ weight ratio of from about 0.5 to about 4.0, are useful salts in the detergent granules of the invention at levels of from about 2% to about 15% on an anhydrous weight basis, preferably from about 3% to about 8%. Anhydrous or hydrated particulate silicate can be utilized, as well.

Any number of additional ingredients can also be included as components in the granular detergent composition. These include other detergency builders, bleaches, bleach activators, suds boosters or suds suppressors, anti-tarnish and anti-corrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference.

Suitable smectite clays for use herein are described in U.S. Pat. No. 4,762,645, Tucker et al., issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al., issued May 5, 1987, both incorporated herein by reference.

The following examples are presented for illustrative purposes only and are not to be construed as limiting the scope of the appended claims in any way.

In the following examples all levels are quoted as % by weight of the composition:

EXAMPLE I

In this example of coating by a non-hydrating inorganic salt, a detergent agglomerate composition was made using the following formula using dry neutralization of HLAS in a high-speed mixer, followed by paste agglomeration with a pre-neutralized NaLAS paste in a second medium speed mixer, followed by spray-on of a Burkeite solution (5% solids basis) in a fluid bed dryer.

| | |
|---|---|
| High Speed Mixer (Dry Neutralization) | |
| Na2CO3 | 59% |
| HLAS | 23% |
| Dry-neutralized intermediate | 82% |
| Medium Speed Mixer (Paste Agglomeration) | |
| Dry-neutralized intermediate | 82% |
| NaLAS paste | 18% |
| Agglomerate core particle | 100% |
| Fluid Bed Coating and Drying | |
| Agglomerate core particle | 100% |
| Fine particle "dusting", (Zeolite, Na2CO3) | 2% |
| Spray on solution* (wet basis) | 17.5% |
| Evaporation | −12.5% |
| Net coating solids (Burkeite) | 5% |
| Coated Product | 107% |

*Solution made up of 1.5 wt % Na2CO3, 3.5 wt % Na2SO4 and 12.5 wt % H2O.

In this example, the spray solution can be made from a burkeite starting material, dissolved in water at ~28.5 wt % solids, or by dissolving a mixture of Sodium Carbonate and Sodium Sulfate salts in a ratio of ~30:70 with a total salt solids loading of ~28.5 wt % in water. The solution is atomized to form droplets which coat or partially coat the particle core agglomerates, then the water is evaporated at a bed temperature of about 40 to 80° C. Upon evaporation, the salts co-precipitate to form the Burkeite coating.

EXAMPLE II

In this example of coating by an organic salt, a granular detergent composition was made using the following formula using a spray-dried core granule, followed by spray-on of a Potassium Citrate solution (5% solids basis) in a fluid bed dryer.

| | |
|---|---|
| Fluid Bed Coating and Drying | |
| Spray-dried core particle | 100% |
| Spray on solution* (wet basis) | 9% |
| Evaporation | −3% |
| Net coating solids (Potassium Citrate) | 6% |
| Coated Product | 106% |

*Solution made up of 3.1 wt % K2CO3, 2.9% Citric Acid and 3 wt % H2O.

In this example, the spray solution was made by co-dissolving Potassium Carbonate and Citric Acid in water. The solution is atomized to form droplets which coat or partially coat the core agglomerates, then the water is evaporated at a bed temperature of about 40 to 80 degrees Centigrade. Upon evaporation, the organic salt, Potassium Citrate forms a coating or partial-coating layer on the surface of the spray-dried granules.

What is claimed is:

1. A process for preparing a detergent particle comprising the steps of:

a) providing a surfactant material which is an anionic surfactant selected from the group consisting of alkyl benzene sulfonates, alkyl sulfates, alkyl alkoxy sulfates, and mixtures thereof with nonionic surfactants, said surfactant material being in the form of a paste or liquid;

b) blending said surfactant material and dry starting detergent materials to form a particle core as an agglomerate;

c) passing said particle core to a coating mixer;

d) providing an aqueous coating solution or slurry comprising water and a water soluble, non-hydrating inorganic material which is the double salt $Na_2SO_4$:$Na_2CO_3$ in a weight ratio of $Na_2SO_4$ to $Na_2CO_3$ of from about 80:20 to about 20:80 to said coating mixer;

e) at least partially coating said particle core with said solution or slurry (d) in said coating mixer to form a detergent particle; and f) removing said water from said detergent particle, whereby the surface area of said detergent particle of step (f) is at least 10% less than that of the particle core of step (e).

2. The process as claimed in claim 1, wherein said coating mixer is selected from the group consisting of low speed mixers, fluid bed mixers, and combinations thereof.

3. The process as claimed in claim 1 wherein said coating mixer is a fluid bed mixer.

4. The process as claimed in claim 1, wherein said water soluble, non-hydrating inorganic material is Burkeite, whereby the surface area of said detergent particle of step (f) is at least 20% less than that of the particle core of step (e).

5. The process as claimed in claim 1 wherein said step of providing said aqueous coating solution further comprises the step of spraying said coating solution into said coating mixer.

* * * * *